US006848703B2

(12) United States Patent
Godde et al.

(10) Patent No.: US 6,848,703 B2
(45) **Date of Patent: *Feb. 1, 2005**

(54) PLATFORM FOR RAISING THE BINDINGS FOR A BOOT, AND BOARD FOR GLIDING OVER SNOW EQUIPPED WITH SUCH A PLATFORM

(75) Inventors: Jean-Christophe Godde, Chimilin (FR); Denis Redor, Voiron (FR); Milena Stefanova, St. Barthelemy de Sechilienne (FR)

(73) Assignee: Skis Rossignol, S.A., Voiron (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/288,549

(22) Filed: Nov. 6, 2002

(65) Prior Publication Data

US 2003/0085550 A1 May 8, 2003

(30) Foreign Application Priority Data

Nov. 6, 2001 (FR) ..... 01 14312

(51) Int. Cl.[7] ..... A63C 5/07
(52) U.S. Cl. ..... 280/607; 280/602
(58) Field of Search ..... 280/607, 602, 280/11.14, 601, 611, 616, 617, 618, 636, 14.22

(56) References Cited

U.S. PATENT DOCUMENTS

| | | | | | |
|---|---|---|---|---|---|
| 5,480,175 | A | * | 1/1996 | Astier et al. | 280/607 |
| 5,513,872 | A | * | 5/1996 | Arduin et al. | 280/602 |
| 5,647,605 | A | * | 7/1997 | Arduin | 280/602 |
| 5,758,894 | A | * | 6/1998 | Maggiolo | 280/602 |
| 5,845,923 | A | * | 12/1998 | Zanco | 280/607 |
| 5,927,743 | A | * | 7/1999 | Mantel | 280/602 |
| 6,193,262 | B1 | * | 2/2001 | Silva | 280/607 |
| 6,217,055 | B1 | | 4/2001 | Silva | |
| 6,244,616 | B1 | * | 6/2001 | Arduin et al. | 280/602 |
| 6,513,826 | B1 | * | 2/2003 | Hangl | 280/602 |
| 6,581,956 | B2 | * | 6/2003 | Kruajitch | 280/618 |
| 6,616,171 | B2 | * | 9/2003 | Kruajitch | 280/607 |
| 6,619,688 | B2 | * | 9/2003 | Billon et al. | 280/607 |
| 6,631,918 | B2 | * | 10/2003 | Silva | 280/607 |
| 6,666,471 | B2 | * | 12/2003 | Gatel | 280/602 |
| 2001/0010420 | A1 | * | 8/2001 | Arduin et al. | 280/611 |
| 2001/0042972 | A1 | * | 11/2001 | Kruajitch | 280/624 |
| 2002/0113411 | A1 | * | 8/2002 | Deborde et al. | 280/607 |
| 2002/0121764 | A1 | * | 9/2002 | Kruajitch | 280/607 |
| 2002/0135157 | A1 | * | 9/2002 | Kruajitch | 280/607 |
| 2003/0025299 | A1 | * | 2/2003 | Noviant | 280/607 |

FOREIGN PATENT DOCUMENTS

| | | |
|---|---|---|
| EP | 1023926 | 8/2000 |
| FR | 2774001 | 7/1999 |
| FR | 2 781 166 | 1/2000 |
| FR | 2 799 981 | 4/2001 |
| WO | WO 99/38583 | 8/1999 |

* cited by examiner

*Primary Examiner*—Christopher P. Ellis
*Assistant Examiner*—Jeff Restifo
(74) *Attorney, Agent, or Firm*—Browdy and Neimark, P.L.L.C.

(57) ABSTRACT

A raising platform (6) is intended for mounting on the upper surface (3) of a board (1) for gliding over snow in order to receive and to raise the bindings securing a user's boot to a board (1) for gliding over snow.

The raising platform (6) is divided into two longitudinal parts (9, 10) that are each placed directly on the upper surface (3) of the board (1) for gliding over snow and that are connected together by at least one bridge (11).

24 Claims, 6 Drawing Sheets

PLATFORM FOR RAISING THE BINDINGS FOR A BOOT, AND BOARD FOR GLIDING OVER SNOW EQUIPPED WITH SUCH A PLATFORM

The present invention relates to a platform for raising the bindings for a boot of a user of a board for gliding over snow.

The present invention also relates to a board for gliding over snow, such as a ski, a monoski or a snowboard, equipped with a platform for raising the bindings for a boot.

A platform for raising the bindings is attached in the underfoot zone of a board for gliding, in the region of its upper surface. The platform is fixed to the board either directly by means of screws, in order to obtain a rigid link, or by virtue of elastic return means in the form, for example, of a layer of material having damping properties.

STATE OF THE ART

A platform is known from document EP-1,023,926, which has the form of two central support elements on which two distinct longitudinal uprights are placed in an overhanging fashion. Two rigid plates connecting the two mounting zones in pairs are screwed to each of the two ends of the two longitudinal uprights to make it possible to mount the binding elements.

A platform is also known from documents FR-2,774,001 and U.S. Pat. No. 6,217,055, having the form of four distinct longitudinal mounting zones. A first transverse plate is screwed to the two front mounting zones and a second transverse plate is screwed to the two rear mounting zones.

The main drawback of this platform is the absence of flexibility which may exist between the two mounting zones which are fully coupled mechanically both by the central support elements and by the two rigid end plates. Furthermore, this type of platform arrangement is difficult to assemble and is relatively heavy.

SUMMARY OF THE INVENTION

The object of the invention is to propose a board for gliding over snow with a platform which is lighter by virtue of a choice of shape and which, moreover, makes it possible to separate the left and right bearing forces so as to transmit the forces applied by the user onto the board and the forces generated more directly in the region of the left edge or the right edge.

The platform according to the invention also makes it possible to give the board for gliding a novel, very slender esthetic appearance, which can allow the protective and decorative layer of the board for gliding to remain visible. The platform according to the invention is also easy to manufacture and to mount on the ski, by virtue of its integral structure. In the present invention, the binding elements are mounted directly on the platform, without the need for an intermediate securing part.

A raising platform is intended for fitting on the upper surface of a board for gliding over snow in order to receive and to raise the bindings securing a user's boot to the board for gliding over snow.

According to the invention, the raising platform is wherein it is divided into two longitudinal parts that are each directly placed on the upper surface of the board for gliding over snow and that are connected together by at least one bridge.

The term "bridge" is understood to mean a central part physically located between the two longitudinal parts and interconnecting them. Preferably, the bridge may be located under the boot. The platform may comprise a bridge that will be positioned between the lines for transmission of the bearing forces of the skier's boot on the platform. Favorably, the platform may comprise a bridge located at the front end of the two longitudinal parts. Favorably, also, the platform may comprise a bridge located at the rear end of the two longitudinal parts. The platform may preferably be produced with one or a number of bridges, which may be in a single piece with each of the two longitudinal parts. The bridge or bridges may also be located in a plane parallel to the gliding sole of the board for gliding over snow. Advantageously, the bridge may have at least one recess.

Preferably, and in another embodiment, at least one of the two longitudinal parts of the platform may comprise at least one recess located in the region of its face of contact with the upper surface of the board for gliding over snow. This or these recesses may be filled with one or more materials which have properties of elasticity and damping.

In certain cases, when the two longitudinal parts are actually separated from one another, a spacing may be provided between the two longitudinal parts. This spacing may be left free. This spacing may also be filled by a convex zone of the board for gliding over snow which projects relative to the upper surface of the upper protective and decorative layer of the board for gliding over snow. This spacing may also be filled with one or more materials having low stiffness in flexure.

In a particularly advantageous manner, at least one of the two longitudinal parts of the platform may itself be divided transversely into at least two transverse pieces. One or more spaces located between at least one of the transverse pieces which are separated from one another may be filled with one or more materials having properties of elasticity and damping.

The two longitudinal parts may, advantageously, and in a third embodiment, be secured to a board for gliding over snow which may have a thickness in the region of the front portion of the zone for fitting the upper platform to the thickness in the region of the rear portion of the zone for fitting the platform.

To secure it to the board for gliding over snow, at least one of the two longitudinal parts of the platform may favorably comprise two different anchoring zones. At least a first anchoring zone may allow a fixed positioning relative to the board for gliding over snow. At least a second anchoring zone, which is different from the first zone, may allow a positioning with sliding relative to the board for gliding over snow. One of the anchoring zones may favorably be provided in the region of the bridge or bridges.

Preferably, at least one of the two longitudinal parts of the platform may have a tubular structure. This tubular structure may be provided over a part of or over all its length and over a part of or over all its width.

In another embodiment, at least one of the two longitudinal parts of the platform may extend laterally via at least one lateral portion. The or the two right and left lateral portions may then descend over each of the two lateral sides of the board for gliding toward the edges of the board for gliding over snow. The lateral portion or the two lateral portions may, optionally, bear on the board for gliding over snow over the lateral sides. One or more of the lateral portions may very favorably each be located in the region of the bridge or bridges. In a variant of this embodiment, the lower edge of the lateral portion or portions of at least one of the two longitudinal parts of the platform may, in a longitudinal plane, have a non-zero angle of inclination relative to the gliding sole of the board for gliding over snow.

A right or left lateral portion of at least one of the two longitudinal parts may be positioned in the region of the zone for installation of the front stop of the binding for the boot on the board for gliding over snow. A right or left lateral portion of at least one of the two longitudinal parts may be positioned in the region of the zone for installation of the rear heelpiece of the binding for the boot on the board for gliding over snow. A lateral portion of at least one of the two longitudinal parts may be positioned in the region of the zone for installation of the front stop of the binding for the boot on the board for gliding over snow and a lateral portion of at least one of the two longitudinal parts may be positioned in the region of the zone for installation of the rear heelpiece of the binding for the boot on the board for gliding over snow.

The platform may have an asymmetry of length between the two longitudinal parts. The platform may have an asymmetry of width between the two longitudinal parts. The platform may have an asymmetry of the means for fitting between the two longitudinal parts. The platform may have an asymmetry in the number of transverse pieces between the two longitudinal parts. The platform may have an asymmetry of structure and of materials between the two longitudinal parts.

In the case of a competition ski, the purpose of the asymmetries mentioned above is to improve the behavior of the two skis when turning, the racer bearing on both his skis. In the case of a recreational ski, the aim of the asymmetries mentioned above is to offer two types of behavior, depending on whether the skier places his pair of skis left/right or, conversely, right/left. This enables the average skier to have the advantage of two pairs of skis in one, i.e. a ski more specifically dedicated to wide-radius turns and a ski more specifically dedicated to short-radius turns.

According to a second aspect of the invention, a board for gliding over snow is equipped with a platform as described above.

The board for gliding may have, on at least one of the two sides, a lateral notch located over the sides and allowing a positioning of the respective lateral portion of at least one of the two longitudinal parts of the platform. Interestingly, the upper surface of the board for gliding over snow may be substantially flush with the rigid upper face of at least one of the two longitudinal parts of the platform. The upper surface of the board for gliding over snow may favorably comprise one or two ribs separated by a central hollow. The one or two ribs may be in the extension toward the front and toward the rear of the one or two longitudinal parts of the platform.

The board for gliding may advantageously comprise a height discontinuity between the front portion of the zone for fitting the platform and the rear portion of the zone for fitting the platform. In this way, the thickness of the board for gliding over snow in the front portion of the zone for fitting the platform may be greater than the thickness of the board for gliding over snow in the rear portion of the zone for fitting the platform.

DESCRIPTION OF THE DRAWINGS

The invention will be properly understood and its various advantages and different characteristics will become more apparent during the following description of the non-limiting illustrative embodiment, with reference to the appended diagrammatic drawings in which.

DETAILED DESCRIPTION

Figure 1:
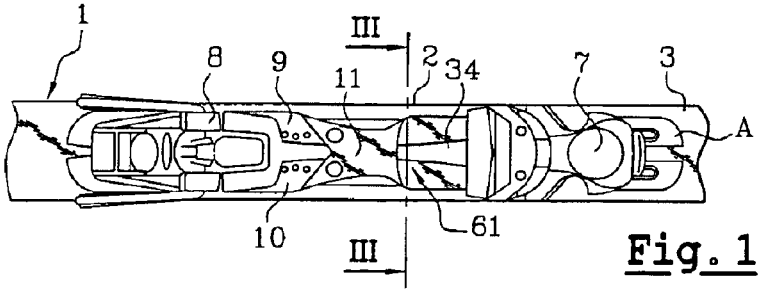
FIG. 1 shows a top view of a platform according to a first embodiment with bindings, mounted on a ski in partial view.
Figure 2:
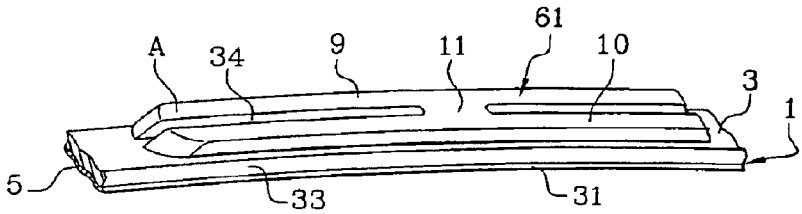
FIG. 2 shows a front lateral perspective view of the platform in FIG. 1, without the bindings and mounted on a ski in partial view.

A board for gliding over snow, of conventional type (cf. FIGS. 1, 2, 3A, 3B, 4, and 5), such as an alpine ski (1), comprises a front zone including a tip, a middle zone called the underfoot zone (2), a rear zone, an upper surface (3) formed by a protective and decorative upper layer (4), and a gliding sole (5). In the region of the underfoot zone (2) there is a platform (61) for raising the elements of the binding.

The platform (61) is placed on the upper surface. Therefore, and contrary to the state of the art, this platform (61) has no need for supports or holding pieces.

The elements of the binding, i.e. the front stop (7) and the heelpiece (8), are screwed onto the raising platform (61). In all the figures, (A) denotes the front of the platform (61) oriented toward the tip, i.e. the part or zone toward which the front stop (7) of the binding for the boot on the ski (1) is more particularly installed.

The platform (61) is divided into two along the central longitudinal axis of the ski (1) and therefore comprises two rigid longitudinal parts (9 and 10). According to the invention, and in a first embodiment, a bridge (11) connects the two rigid longitudinal parts (9 and 10) in their median zone. In other words, the platform (61) comprises two slots made in the region of its median longitudinal axis, i.e. also in the region of the median longitudinal axis of the ski (1), and emerging toward the front (A) and toward the rear.

The bridge (11) is positioned in a portion outside the securing for the elements of the binding (7 and 8). In order to allow transmission of the forces between one of the longitudinal parts (9) and the edge (31) associated with it, the bridge (11) will be located between the zones of transmission of the forces (F) (see FIG. 5) of the skier on the platform (61), i.e. between the front and rear supports of the ski boot. The transmission of the forces (F) takes place partly via the screws for securing the elements of the binding (7 and 8).

Although the positioning of the elements of the binding (7 and 8) and therefore of the boot may be variable, particularly by reason of the various boot sizes or of the adjustment desired by the skier, the bridge (11) is placed under the boot. This bridge (11) is thus placed relatively centrally with respect to the length of the two longitudinal parts (9 and 10). The platform (61) seen from the top will have the form of a cross or of a regular X with four branches that are substantially the same length.

Figures 3A, 3B:
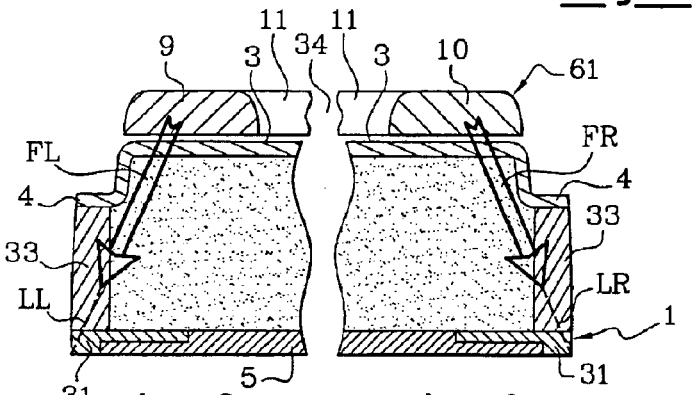
FIGS. 3A and 3B, respectively, show a left view and a right view in transverse section in the plane III—III of the ski in FIG. 1.

The possibility of having two fairly distinct longitudinal parts (9 and 10) will mean that the bearing forces exerted by the skier on one or other of the two longitudinal parts (9 or 10) will be transmitted directly to the edge (31) associated with it, and located just below, when, during a turn, the skier tilts his ski (1) onto this edge (31). The transmission of the forces is more particularly represented in FIG. 3A, in which the skier, weighting the left edge (31), generates the force (FL), with its force transmission line (LL) (shown in dashes) starting from the first longitudinal part (9) and continuing to the left edge (31). In FIG. 3B, the skier, weighting the right edge (31), generates the force (FR), with its force transmission line (LR) (shown in dashes) starting from the second longitudinal part (10) and continuing to the right edge (31).

Thus, because of the partial mechanical separation of the two longitudinal parts (9 and 10) which are thus for the most part functionally disconnected, the bearing forces and the forces generated on one (9) of the longitudinal parts will be transmitted only very slightly to the other (10) of the longitudinal parts.

In FIGS. 1, 2, 3A, 3B, 4, 6, 7, 8, 10, 11, 13, 14, 15, 17 and 23, the two longitudinal parts (9 and 10) are transversely clearly separated from one another, with a distance between them. This chosen separation means that the platform (6) gains in lightness, owing to the quasi-absence of material and the lack of weight in the center of the two, front (A) and rear, ends.

In order to ensure that the platform (61) is held on the ski (1), the platform (61) is screwed directly onto the upper surface (3) of the ski (1). The screws pass via through-holes made through each of the two longitudinal parts (9 and 10) and through the bridge (11).

Figure 4:
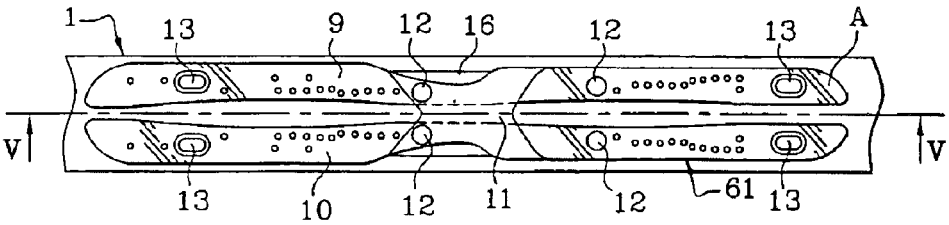
FIG. 4 shows a top view of the platform according to the first embodiment, mounted on a ski in partial view.
Figure 5:
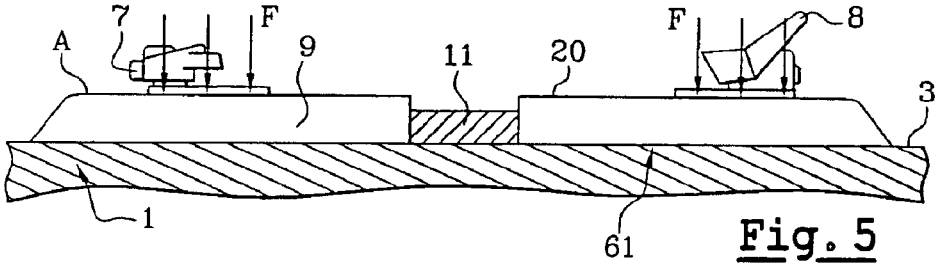
FIG. 5 shows a partial view in longitudinal section of the platform in the plane V—V in FIG. 4.
Figure 6:
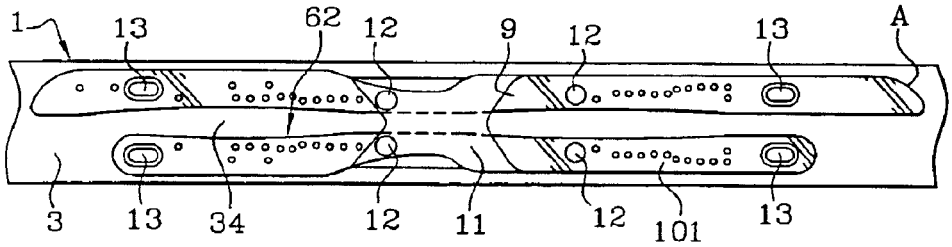
FIG. 6 shows a top view of a platform according to a second embodiment, mounted on a ski in partial view.
Figure 7:
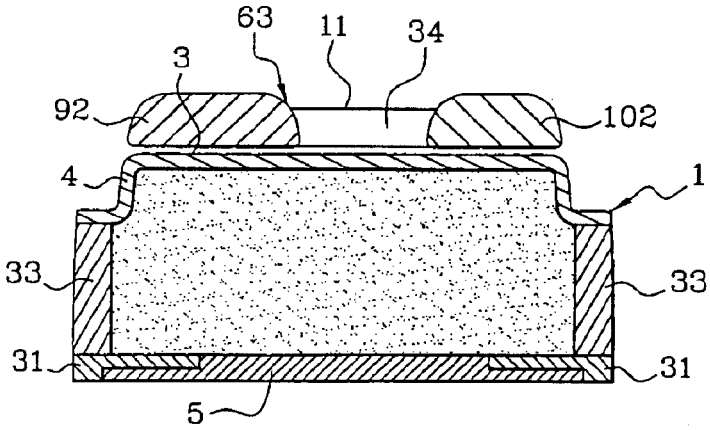
FIG. 7 shows a transverse-sectional view of a ski with a platform according to a third embodiment.
Figure 8:
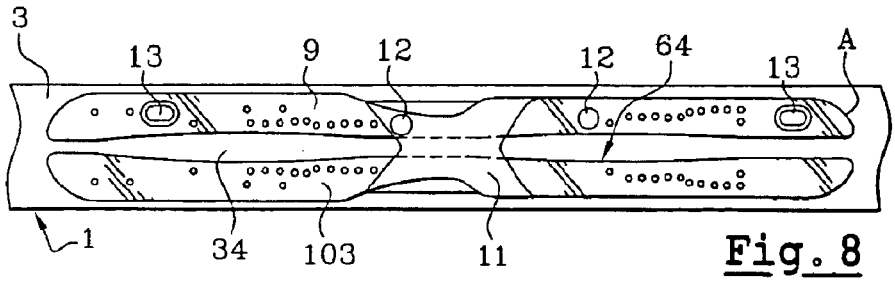
FIG. 8 shows a top view of a platform according to a fourth embodiment, mounted on a ski in partial view.

The platform (61) comprises four different anchoring zones (cf. FIGS. 4 and 6). Two first anchoring zones or securing means allow a fixed positioning of the platform (61) relative to the ski (1). These first two anchoring zones consist of round holes (12). With these round holes (12), which are sized and which have a diameter which is substantially equal to the diameter of the securing screw, no movement of the platform (61) relative to the rest of the ski (1) is possible. One round hole (12) has thus been provided toward the front third of each of the two longitudinal parts (9 and 10) and a further two round holes (12) have been provided at the rear of the bridge (11).

Two second anchoring zones or securing means allow a positioning with sliding of the platform (61) relative to the ski (1). These two second anchoring zones consist of elongate holes (13). With these elongate holes (13), having a width which is substantially equal to the diameter of the securing screw and sized in terms of length so that they can allow an offset of the platform (61), only a sliding in the longitudinal direction of the platform (61) relative to the rest of the ski (1) is possible. Two elongate holes (13) have thus been provided toward the two, front and rear, ends of each of the two longitudinal parts (9 and 10).

Toward the front third of each of the two longitudinal parts (9 and 10) and toward the rear of the bridge (11), the two fixed anchoring zones (12) add stiffness to the inherent stiffness of the ski (1). In the region of the two ends of each of the two longitudinal parts (9 and 10), with the two sliding anchoring zones (13), the ski (1) is thus free to deform without undergoing platform (61) stresses. The same platform (61) thus makes it possible to obtain different behaviors by means of a simple adjustment carried out by the end-user.

In a second embodiment (cf. FIG. 6), the platform (62) comprises two distinct rigid longitudinal parts (9 and 101) and the bridge (11) linking them. However, this platform (62) has an asymmetry of shape between the two longitudinal parts (9 and 101). The first longitudinal part (9) has a length corresponding to the length of the two longitudinal parts (9 and 10) of the first embodiment. The second longitudinal part (101) has a length which is shorter than that of the first longitudinal part (9). The first longitudinal part (9), the longer part, is preferably on the side of the inner edge (31) of the ski (1). The second longitudinal part (101), the shorter part, is preferably fitted on the side of the outer edge (31) of the ski (1). The two skis, the inner ski and the outer ski relative to the turn, bend differently and thus produce different turn radii.

In a third embodiment (cf. FIG. 7), the platform (63) comprises two distinct rigid longitudinal parts (92 and 102) and the bridge (11) linking them. However, this platform (63) has an asymmetry of shape between the two longitudinal parts (92 and 102). The first longitudinal part (92) has a width greater than that of the two longitudinal parts (9 and 10) of the first embodiment. The second longitudinal part (102) has a width which is less than that of the two longitudinal parts (9 and 10) of the first embodiment. The second longitudinal part (102) is preferably fitted on the side of the outer edge (31) of the ski (1). This makes it possible to obtain an inside ski during the turn which is different from the outside ski during the turn and thus to have different turn radii.

In a fourth embodiment (cf. FIG. 8), the platform (64) comprises two distinct rigid longitudinal parts (9 and 103). However, this platform (64) has an asymmetry of anchoring or, alternatively, an asymmetry of the fixing means between the two longitudinal parts (9 and 103). The first longitudinal part (9) has the two anchoring zones (12 and 13) corresponding to the two anchoring zones (12 and 13) already described above for the first embodiment. The second longitudinal part (103) has no anchoring zones, or else has anchoring zones that are not used. This second longitudinal part (103) is, for example, adhesively bonded to the ski (1). Provision may also be made for two different types of adhesive bonding for each of the longitudinal parts. In this way, the contacts and deformations of the ski differ between the inside ski during turning and the outside ski during turning, the platform separating the right bearing forces and the left bearing forces.

Figure 9:
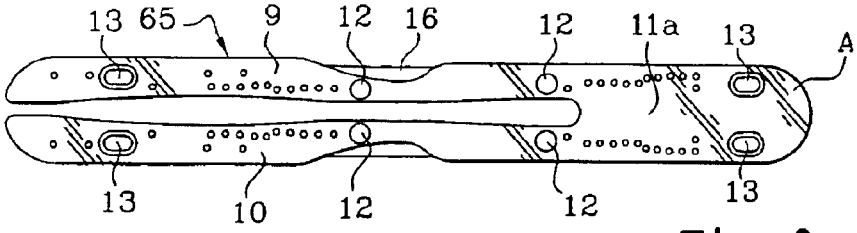
FIG. 9 shows a top view of a platform according to a fifth embodiment.
Figure 10:
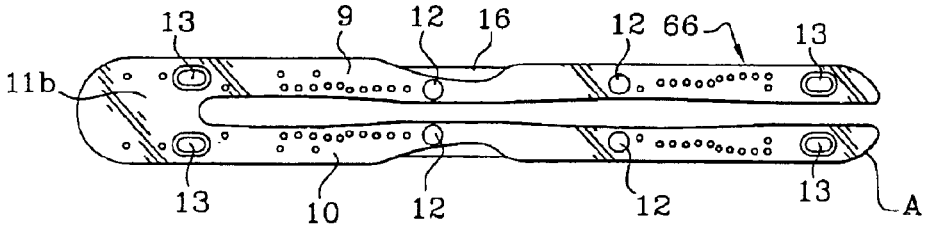
FIG. 10 shows a top view of a platform according to a sixth embodiment.
Figure 11:
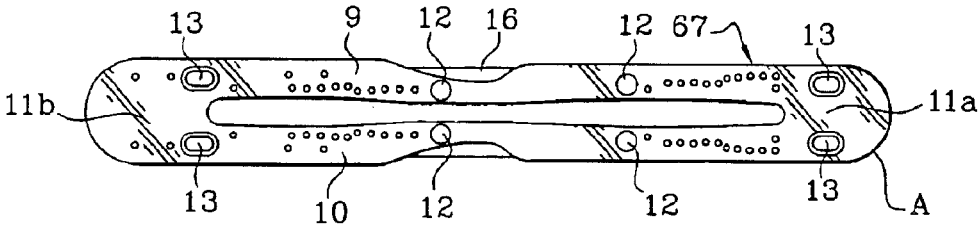
FIG. 11 shows a top view of a platform according to a seventh embodiment.

In a fifth embodiment (cf. FIG. 9), the platform (65) comprises a bridge (11*a*) positioned in the region of its front part (A). In other words, the platform (65) comprises a slot made in the region of its median longitudinal axis, i.e. also in the region of the median longitudinal axis of the ski (1), and emerging toward the rear. This positioning of the bridge (11*a*) makes it possible to enhance the initiation of a curve by the ski (1).

In a sixth, preferred embodiment (cf. FIG. 10), the platform (66) comprises a bridge (11*b*) positioned in the region of its rear part. In other words, the platform (66) comprises a slot made in the region of its median longitudinal axis, i.e. also in the region of the median longitudinal axis of the ski (1), and emerging toward the front (A). This positioning of the bridge (11*b*) makes it possible to confer power and a boost at the end of a turn.

In a seventh embodiment (cf. FIG. 11), the platform (67) comprises two bridges (11*a* and 11*b*) positioned, respectively, in the region of its front part (A) and of its rear part. In other words, the platform (67) comprises a slot made in the region of its median longitudinal axis, i.e. also in the region of the median longitudinal axis of the ski (1), and in a central position.

The various bridges (11, 11*a* and 11*b*) have a length substantially between 5% and 30% of the length of each of the two longitudinal parts (9 and 10). The bridges (11, 11*a* and 11*b*) extend from one longitudinal part (9) to the other longitudinal part (10), in a plane parallel to the gliding sole (5) of the ski (1). It will also be noted that there is a variation between the thickness of the rigid upper face (20) of each of the two longitudinal parts (9 and 10) and the thickness of the bridge (11) (cf. FIG. 5). The bridges (11, 11*a* and 11*b*), like the two longitudinal parts (9 and 10), are produced in a light alloy, for example aluminum, in a single piece with the two longitudinal parts (9 and 10). The bridges (11, 11*a* and 11*b*) may also be provided in the form of attached pieces fixed by screws or, alternatively, adhesively bonded to the two longitudinal parts (9 and 10), and are made from a different material.

Figure 12:
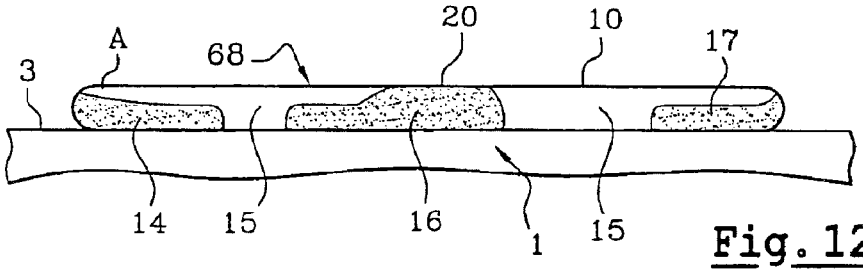
FIG. 12 shows a partial lateral view of a ski with a platform according to an eighth embodiment.
Figure 13:
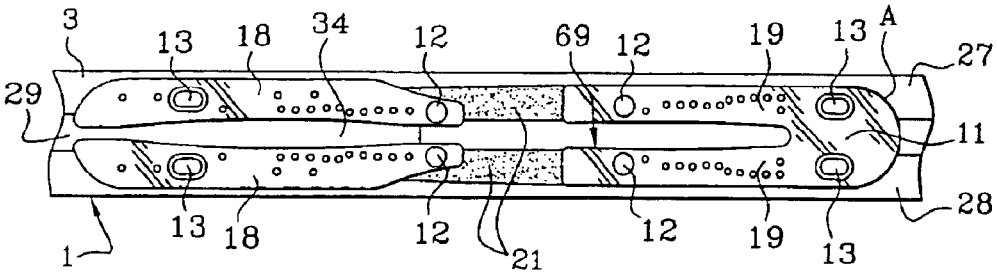
FIG. 13 shows a top view of a platform according to a ninth embodiment, mounted on a ski in partial view.
Figure 14:
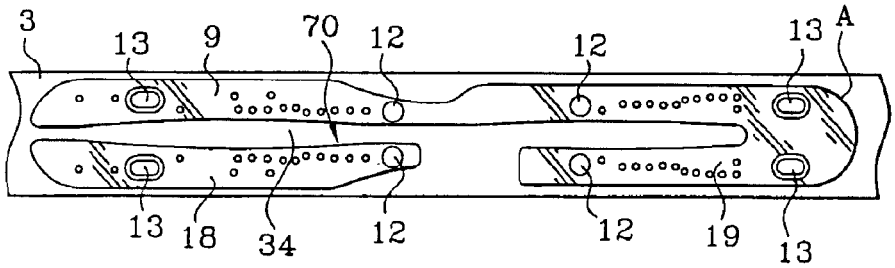
FIG. 14 shows a top view of the platform according to a tenth embodiment, mounted on a ski in partial view.
Figure 15:
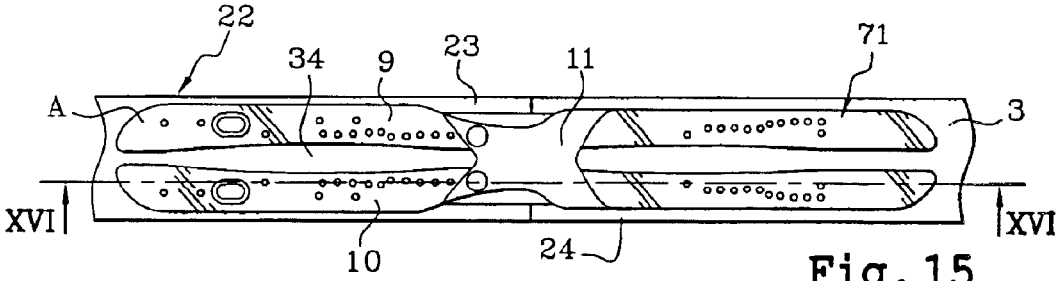
FIG. 15 shows a top view of a platform according to an eleventh embodiment, mounted on a ski in partial view.

In an eighth embodiment (cf. FIG. 12), each of the two longitudinal parts (9 and 10) and the bridge of the platform (68) comprise three recesses (14, 16 and 17) located in the region of its face of contact with the upper surface (3) of the ski (1). Between the recesses (14, 16 and 17), the two longitudinal parts (9 and 10) comprise rigid sectors (15) connected to the rigid upper face (20) of each of the two longitudinal parts (9 and 10) and of the bridge (11).

The recess (14) is located at the front (A) of the two longitudinal parts (9 and 10) of the platform (6). The recess (16) is located in the center of the two longitudinal parts (9 and 10) and of the bridge (11) of the platform (6). The recess (17) is located to the rear of the two longitudinal parts (9 and 10) of the platform (6). The shape of the central recess (16) is also arranged so as substantially to notch the upper face (20) of the two longitudinal parts (9 and 10).

The recesses (14, 16 and 17) may be filled with one or more materials having properties of elasticity and damping. By way of example, in the central (16) and rear (17) recesses, use will be made of a material which will be described as "low-level damping material", i.e. having properties of elasticity with an intrinsic damping coefficient tg $\delta<0.4$, preferably tg $\delta$ between 0.1 and 0.4, measured using standard NF T 46 026 (at temperatures of −30° C. to +10° C. and at frequencies of 0.1 Hz to 120 Hz). This will allow a rebound, dynamic range and rapid transmission of impulses of the skier's foot. Elastomers such as natural rubbers, polychloroprenes, butyl rubbers or EPDM will be materials suited for such uses.

Additionally, by way of example, in the front recess (14) use will be made of a material which will be described as "viscoelastic" or "damping", i.e. having properties of elasticity with an intrinsic damping coefficient tg $\delta>0.4$, preferably tg $\delta$ between 0.8 and 1, measured using standard NF T 46 026 (at temperatures of −30° C. to +10° C. and at frequencies of 0.1 Hz to 120 Hz). This will allow damping of the vibrations originating from the ski (1) and will give the skier a greater level of comfort. Elastomers such as chlorobutyls, nitrites or polyisoprenes will be suitable materials for such uses.

In another embodiment (not shown), the platform comprises two distinct rigid longitudinal parts. However, this platform has an asymmetry of structure between the two longitudinal parts. Use may be made of two different materials for each of the two longitudinal parts. Different stiffnesses will be envisaged, with a first longitudinal part produced by way of example from polyamide and a second longitudinal part produced from aluminum. Further, by way of example, one of the longitudinal parts with its recesses may have damping properties, whilst the other of the longitudinal parts with its recesses may have rebound properties.

In a ninth embodiment (cf. FIG. 13), the bridge (11) is located at the front (A) of the platform (69), in a manner substantially similar to the fifth embodiment. Each of the two longitudinal parts (9 and 10) is itself divided transversely into two transverse pieces (18 and 19). Each of these transverse pieces (18 and 19) is separate from the other, with a certain distance between them.

The spaces located between the transverse pieces (18 and 19) are filled with one or more materials (21) having properties of elasticity and/or damping. This material (21) makes it possible physically to secure the transverse pieces (18 and 19) whilst allowing them freedom of movement.

In a tenth embodiment (cf. FIG. 14), the platform (70) comprises two distinct rigid longitudinal parts. However, this platform (70) has an asymmetry of the number of component pieces between the two longitudinal parts. The first longitudinal part (9) has the same dimensional and structural characteristics as the longitudinal parts (9 and 10) of the first embodiment.

The second longitudinal part is itself divided into two transverse pieces (18 and 19). The two transverse pieces (18 and 19) of this second longitudinal part are preferably fitted on the side of the outside edge (31) of the ski (1).

Figure 16:
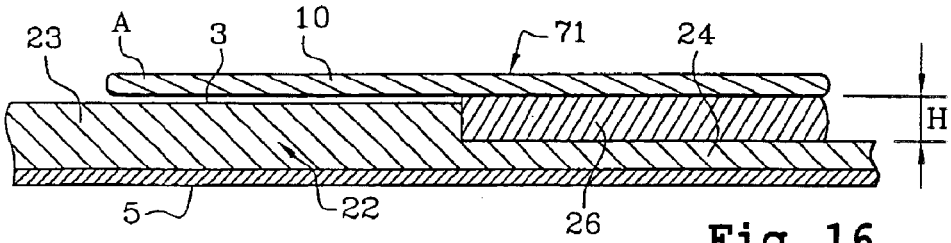
FIG. 16 shows a partial view in longitudinal section of the ski and its platform in the plane XVI—XVI in FIG. 15.

In an eleventh embodiment (cf. FIGS. 15 and 16), the two longitudinal parts (9 and 10) and the bridge (11) of the platform (71) are of the type described above in the first embodiment. The ski (22) on which they are fixed has a height discontinuity (H) in the middle of its underfoot zone (23). Consequently, the ski (22) will have, in its front underfoot zone (23), a thickness which is greater than the thickness of the rear underfoot zone (24).

The two longitudinal parts (9 and 10) and the bridge (11), in all or in part, of the platform (71) are fitted to the rear, overhanging, or alternatively they may rest at the rear on a thickness of material (26) having properties of elasticity. Use will preferably be made of a material (26) having properties of elasticity with an intrinsic damping coefficient tg $\delta<0.4$, preferably tg $\delta$ between 0.1 and 0.4, measured using standard NF T 46 026 (at temperatures of −30° C. to +10° C. and frequencies of 0.1 Hz to 120 Hz).

In the majority of cases, the two longitudinal parts (9 and 10) are transversely separated from one another by two spacings (34) to the front and to the rear of the bridge (11) when the latter is in the central position in accordance with the first embodiment. When these spacings (34) are left free, the upper surface (3) of the upper protective and decorative layer (4) is visible, which creates interesting esthetic effects. The spacings (34) may also be filled with one or more materials, in the form of an attached element, which is transparent or may optionally be colored, and preferably a material with a low flexural strength.

Figure 17:
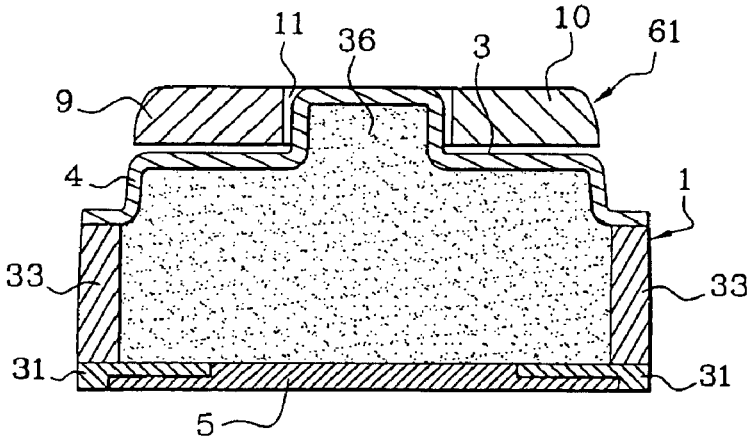
FIG. 17 shows a transverse-sectional view of a ski with a platform according to a twelfth embodiment.

In a twelfth embodiment (cf. FIG. 17, in which a "Dualtec®"-type ski (1) is more particularly shown), the spacings (34) are filled by a convex zone (36) of the ski (1). This convex zone (36) protrudes between the two longitudinal parts (9 and 10) of the platform (61), like that of the first embodiment, relative to the upper surface (3) of the upper protective and decorative layer (4). This makes it possible to prevent, for example, snow and ice becoming packed into the zone of the spacings (.34) whilst preserving the partial mechanical separation of the two longitudinal parts (9 and 10).

Figure 18:
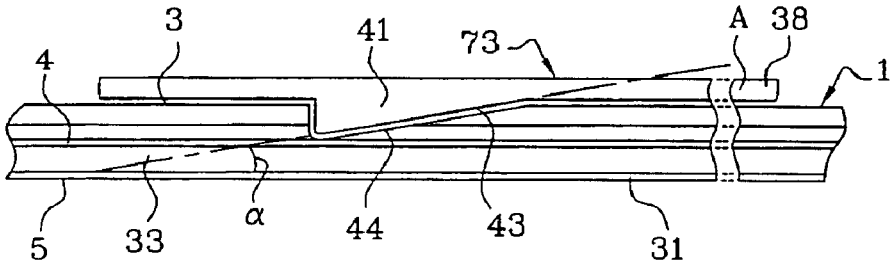
FIG. 18 shows a partial lateral view of a ski with a platform according to a thirteenth embodiment.

In a thirteenth embodiment (cf. FIG. 18), the platform (73) with each of the two longitudinal parts (37 and 38) is extended laterally via a lateral portion or an appendix, respectively, (39 and 41). The two lateral portions (39 and 41) descend over each of the two lateral sides of the ski (1) toward the edges (31). The longitudinal location of the lateral sides (39 and 41) may correspond to the longitudinal location of the bridge (11).

To allow this arrangement, the ski (1) comprises, laterally, two hollowed zones, i.e. two lateral notches (44) located over the sides (33), having a similar shape that complements the two lateral portions (39 and 41) and which allow a positioning of these two lateral portions (39 and 41) of the two longitudinal parts (37 and 38). The two lateral portions (39 and 41) bear more directly via their edge or lower section (43) on the ski (1), over the lateral sides (33). The lower edge (43) is located only in a portion (41) of the lateral edge of the two longitudinal parts (38), being deployed downwards toward the edges (31).

It will be noted that the edges (43) of the two lateral portions (39 and 41) may be parallel to the gliding surface (5) of the ski (1). The edges (43) of the two lateral portions (39 and 41) may also not be parallel to the gliding surface (5) of the ski (1) and, in such a case, a lower edge (43) of the two longitudinal parts (38) is not parallel to the surface of the gliding sole (5).

The lower edge (43) then has, in a longitudinal plane, a non-zero angle of inclination ($\alpha$) relative to the surface of the gliding sole (5) or relative to the upper surface (3) of the upper protective and decorative layer (4) of the ski (1). This angle ($\alpha$) is substantially between 1 and 20°, and preferably substantially between 2 and 5°.

This lateral portion (29) is positioned substantially in the middle of the two longitudinal parts (28) for example in the region of the bridge (11). This makes it possible to transfer the right and left impulses imparted by the skier directly toward the right and left edges (31) of the ski (1).

Figure 19:
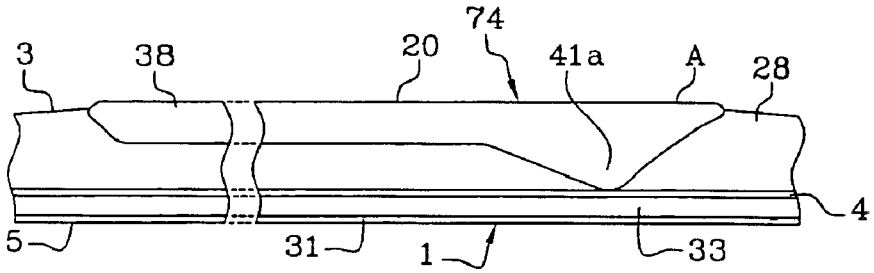
FIG. 19 shows a partial lateral view of a ski with a platform according to a fourteenth embodiment.

In a fourteenth embodiment (cf. FIG. 19), substantially with reference to the thirteenth embodiment described above, the platform (74) with each of the two longitudinal parts (38) comprises a lateral portion (41). These two lateral portions (41) are more particularly positioned in the region of the zone of installation of the front stop of the binding for the boot on the ski (1) of each of the two longitudinal parts (38). This makes it possible more efficiently to transfer the impulses toward the front part of the right and left edges (31) of the ski (1) imparted by the skier when initiating a turn.

Figure 20:
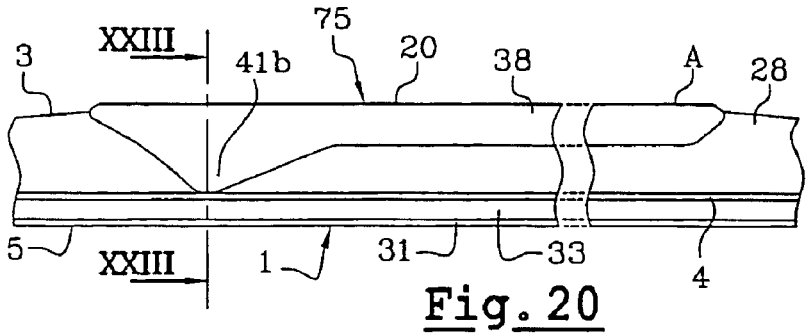
FIG. 20 shows a partial lateral view of a ski with a platform according to a fifteenth embodiment.

In a fifteenth embodiment (cf. FIGS. 20 and 23), substantially with reference to the thirteenth embodiment described above, the platform (75) with each of the two longitudinal parts (37 and 38) comprises a lateral portion (41). These two lateral portions (41) are more particularly positioned in the region of the zone of installation of the rear heelpiece of the binding for the boot on the ski (1) of each of the two longitudinal parts (37 and 38). This makes it possible more efficiently to transfer the impulses toward the rear part of the right and left edges (31) of the ski (1) imparted by the skier when exiting a turn.

Figure 21:
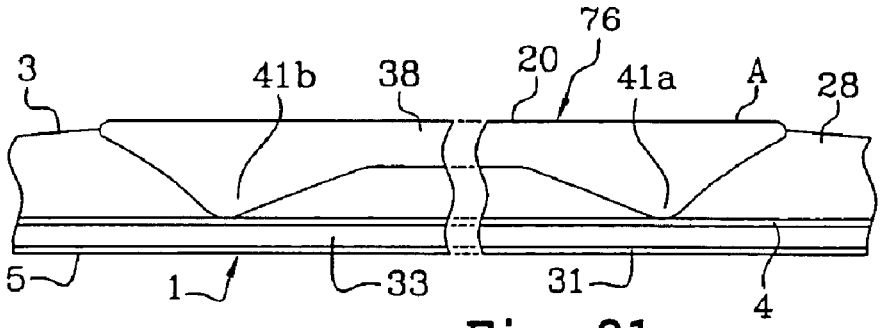
FIG. 21 shows a partial lateral view of a ski with a platform according to a sixteenth embodiment.

In a sixteenth embodiment (cf. FIG. 21), substantially with reference to the thirteenth embodiment described above, the platform (76) with each of the two longitudinal parts (38) comprises two lateral portions (41*a* and 41*b*). These four lateral portions (41*a* and 41*b*) are more particularly positioned in the region of the zones of installation of the front stop and of the rear heelpiece of the bindings for the boot on the ski (1) of each of the two longitudinal parts (38). This makes it possible more efficiently to transfer the impulses both toward the front and toward the rear of the right and left edges (31) imparted by the skier when initiating and exiting a turn.

In a seventeenth embodiment (cf. FIG. 22), substantially with reference to the sixteenth embodiment described above, the platform (77) with each of the two longitudinal parts (38) comprises two lateral portions (41*a* and 41*b*) which are more particularly positioned in the region of the zones of installation of the front stop and rear heelpiece of the bindings for the boot on the ski (1) of each of the two longitudinal parts (38).

Figure 22:
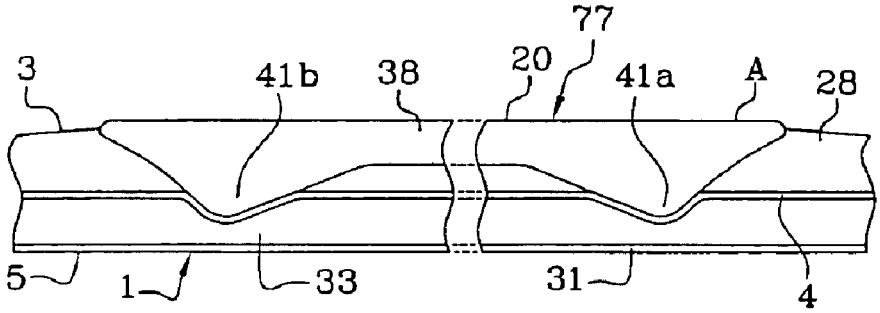
FIG. 22 shows a partial lateral view of a ski with a platform according to a seventeenth embodiment.
Figure 23:
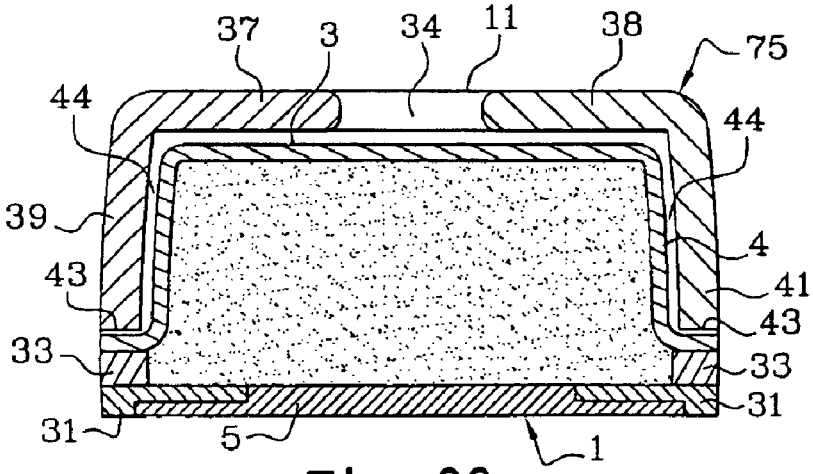
FIG. 23 shows a transverse-sectional view in the plane XXIII—XXIII in FIG. 20 of a ski with its platform according to the fifteenth embodiment.

In FIGS. 18, 19, 20 and 21, the sides (33) have a constant height. In FIG. 22, the sides (33) have a variable height that is smaller in the region of the lateral portions (41*a* and 41*b*) and greater in the center, to the front and to the rear of the platform. The upper protective and decorative layer (4) in this case matches the shape of the sides (33).

In all the embodiments (cf., however, more particularly, FIGS. 13, 19, 20, 21 and 22, the upper surface (3) of the ski (1) comprises two ribs (27 and 28) separated by a central hollow or dip (29). The two ribs (27 and 28) are in the forward extension toward the tip and in the rearward extension of each of the two longitudinal parts (18 and 38) of the platform (69, 74, 75, 76 and 77).

In order to obtain a particularly interesting esthetic effect (cf. more particularly FIGS. 19, 20, 21 and 22), the upper surface (3) of the ski (1) is substantially flush with the rigid upper face (20) of the two longitudinal parts (37 and 38) of the platform (74, 75, 76 and 77).

The present invention is not limited to the embodiments described and illustrated. A number of modifications may be made without thereby departing from the field defined by the scope of the set of claims.

The various embodiments described above may be combined with one another. Moreover, the platform (6) may be fitted on all types of ski (1), "DUALTEC®"-type skis, "rectangular-section" skis and "shell-structure" skis.

What is claimed is:

1. A raising platform for fitting on the upper surface (3) of a board (1) for gliding over snow in order to receive and to raise binding elements (7, 8) securing a user's boot to the board (1) for gliding over snow, wherein said platform is divided into two longitudinal parts (9, 10), an entire length of each of the two longitudinal parts (9, 10) engaged directly on the upper surface (3) of the board (1) for gliding over snow (1) and that are connected together only at one end thereof by at least least one bridge (11, 11*a*, 11*b*), the binding elements (7, 8) being mounted directly on said raising platform, at least one of the binding elements (7, 8) being mounted on the two longitudinal parts (9, 10) outside the bridge (11, 11*a*, 11*b*).

2. The platform as claimed in claim 1, wherein said comprises a bridge (11) located under the boot, positioned between the lines for transmitting a force from the user's boot on the platform (61).

3. The platform as claimed in claim 1, wherein said comprises a bridge (11*a*) located at the front end (A) of the two longitudinal parts (9, 10).

4. The platform as claimed in claim 1, wherein said comprises a bridge (11*b*) located at the rear end of the two longitudinal parts (9, 10).

5. The platform as claimed in claim 1, said at least one bridge (11, 11*a*, 11*b*) are in a single piece with each of the two longitudinal parts (9, 10) and are in a plane parallel to a gliding sole (5) of the board (1) for gliding over snow and to the upper surface (3) of the board (1) for gliding over snow.

6. The platform as claimed in claim 1, said at least one bridge (11) have at least one recess.

7. The platform as claimed in claim 1, wherein at least one of the two longitudinal parts (9, 10) comprises at least one recess (14, 16, 17) located in the region of its face of contact with the upper surface (3) of the board (1) for gliding over snow, and in that one or more of said recesses (14, 16, 17) are filled with one or more materials which have properties of elasticity and damping.

8. The platform as claimed in claim 1, wherein a spacing (34) is provided between the two longitudinal parts (9, 10) which are separated from one another, and in that the spacing (34) is filled by a convex zone (36) of the board (1) for gliding over snow which projects relative to the upper surface (3) of an upper protective and decorative layer of the board (1) for gliding over snow or in that the spacing (34) is filled by one or more materials with low flexural strength.

9. The platform as claimed in claim 1, wherein at least one of the two longitudinal parts (9, 10) is divided transversely into at least two transverse pieces (18, 19), and in that a space or spaces located between at least one of the transverse pieces (18, 19) which are separated from one another are filled with one or more materials (21) which have properties of elasticity and damping.

10. The platform as claimed in claim 1, wherein said platform is secured to said board (1) for gliding over snow having a thickness in the region of the front portion (23) of the zone for fitting the platform (6) greater than the thickness in the region of the rear portion (24) of the zone for fitting the platform (6).

11. The platform as claimed in claim 1, wherein at least one of the two longitudinal parts (9, 10) comprises two anchoring zones (12, 13), at least a first anchoring zone (12) allowing a fixed positioning relative to the board (1) for gliding over snow and at least a second anchoring zone (13) allowing a positioning with sliding relative to the board (1) for gliding over snow, and in that at least one of the anchoring zones (13) is arranged in the region of the said at least one bridge (11).

12. The platform as claimed in claim 1, wherein at least one of the two longitudinal parts (9, 10) has a tubular structure over a part of or over all its length and over a part of or over all its width.

13. The platform as claimed in claim 1, wherein at least one of the two longitudinal parts (9, 10) extends laterally via at least one lateral portion (39, 41, 41*a*, 41*b*) descending over each of the two lateral sides toward the edges (31) of the board (1) for gliding over snow, in that at least one of the lateral portions (39, 41, 41*a*, 41*b*) may bear on the board (1) for gliding over snow above the lateral sides (33), and in that one or more of the lateral portions (39, 41, 41*a*, 41*b*) are each located in the region of the bridge or bridges (11, 11*a*, 11*b*).

14. The platform as claimed in claim 13, wherein the lower edge (43) of the lateral portion or portions (41) of at least one of the two longitudinal parts (9, 10) has, in a longitudinal plane, a non-zero angle of inclination ($\alpha$) relative to the gliding sole (5) of the board (1) for gliding over snow.

15. The platform as claimed in claim 13, wherein at least one of the two longitudinal parts (9, 10) extends laterally via a lateral portion (41*a*) positioned in the region of the zone for installation of the front stop (7) of the binding for the boot on the board (1) for gliding over snow.

16. The platform as claimed in claim 13, wherein at least one of the two longitudinal parts (9, 10) extends laterally via a lateral portion (41*b*) positioned in the region of the zone for installation of the rear heelpiece (8) of the binding for the boot on the board (1) for gliding over snow.

17. The platform as claimed in claim 16, wherein it has an asymmetry of length between the two longitudinal parts (9, 101) and/or an asymmetry of width between the two longitudinal parts (92, 102) and/or an asymmetry of the means for fitting between the two longitudinal parts (9, 103) and/or an asymmetry in the number of transverse pieces between the two longitudinal parts (9, 18, 19) and/or an asymmetry of structure and of materials between the two longitudinal parts.

18. The platform as claimed in claim 13, wherein at least one of the two longitudinal parts (9, 10) extends laterally via a lateral portion (41*a*) positioned in the region of the zone for installation of the front stop (7) of the binding for the boot on the board (1) for gliding over snow and via a lateral portion (41*b*) positioned in the region of the zone for installation of the rear heelpiece (8) of the binding for the boot on the board (1) for gliding over snow.

19. The platform as claimed in claim 13, wherein it has an asymmetry between the two longitudinal parts.

20. A board for gliding over snow, wherein said board is equipped with a platform (61, 62, 63, 64, 65, 66, 67, 68, 69, 70, 71, 73, 74, 75, 76, 77) as claimed in claim 1.

21. The board for gliding over snow as claimed in claim 20, wherein it has, on at least one of the two sides, a lateral notch (32, 44) located over the sides (33) and allowing a positioning of the respective lateral portion (41, 41*a*, 41*b*) of at least one of the two longitudinal parts (37, 38) of the platform (75).

22. The board for gliding over snow as claimed in claim 20, wherein an upper surface (3) of said board (1) for gliding over snow is substantially flush with the rigid upper face (20) of at least one of the two longitudinal parts (38) of the platform (74).

23. The board for gliding over snow as claimed in claim 20, wherein an upper surface (3) of said board (1) for gliding over snow comprises one or two ribs (27, 28) which are separated by a central hollow (29), the one or two ribs (27, 28) being in the extension toward the front and toward the rear of the one or two longitudinal parts (18, 19) of the platform (69).

24. The board for gliding over snow as claimed in claim 20, wherein said board (22) for gliding over snow comprises a height discontinuity (H) between the front portion (23) of the zone for fitting the platform (71) and the rear portion (24) of the zone for fitting the platform (71) such that the thickness of the board (22) for gliding over snow in the front portion (23) of the zone for fitting the platform (71) is greater than the thickness of the board (22) for gliding over snow in the rear portion (24) of the zone for fitting the platform (71).

* * * * *